US008061085B2

(12) United States Patent
Anderson

(10) Patent No.: US 8,061,085 B2
(45) Date of Patent: Nov. 22, 2011

(54) HANDRAIL FOR PREVENTING STAIRWAY FALLS

(76) Inventor: John S. Anderson, Glen Arm, MD (US)

( * ) Notice: Subject to any disclaimer, the term of this patent is extended or adjusted under 35 U.S.C. 154(b) by 0 days.

(21) Appl. No.: 12/925,468

(22) Filed: Oct. 21, 2010

(65) Prior Publication Data

US 2011/0042638 A1 Feb. 24, 2011

Related U.S. Application Data

(63) Continuation-in-part of application No. 11/998,633, filed on Nov. 30, 2007, now abandoned.

(51) Int. Cl.
*E04F 11/18* (2006.01)

(52) U.S. Cl. ..... 52/27; 52/182; 52/745.19

(58) Field of Classification Search ..... 52/27, 182, 52/DIG. 13, 745.19; 182/129, 106; 198/322, 198/323, 337; 128/878, 879; 602/20, 21
See application file for complete search history.

(56) References Cited

U.S. PATENT DOCUMENTS

| | | | | |
|---|---|---|---|---|
| 3,992,832 A | | 11/1976 | Ferwerda | 52/173 |
| 4,253,287 A | * | 3/1981 | Overmoe | 52/184 |
| 4,899,989 A | | 2/1990 | Kitson | 256/1 |
| 5,167,297 A | | 12/1992 | Stevenson | 182/3 |
| 5,899,298 A | | 5/1999 | Crouse | 182/234 |
| 6,270,058 B1 | | 8/2001 | Williams | 256/59 |
| 7,093,825 B2 | | 8/2006 | Kawamure | 256/59 |
| 2006/0243112 A1 | * | 11/2006 | Debrunner | 83/455 |
| 2007/0017170 A1 | * | 1/2007 | Manson et al. | 52/184 |

FOREIGN PATENT DOCUMENTS

DE 19518245 A1 * 11/1996

* cited by examiner

*Primary Examiner* — Brian Glessner
*Assistant Examiner* — Christine T Cajilig
(74) *Attorney, Agent, or Firm* — Larry J. Guffey

(57) ABSTRACT

To further prevent stairway falls, an otherwise conventional handrail, of the type that is mounted on the sidewall of a stairway and has an upper portion which is configured to be easily grasped by one utilizing, is modified by providing it with a two-part cavity in the interior of the handrail, with its first part being a slot that extends from the handrails' exterior surface and its second part being a bore that is situated in the handrail's interior and joined with the slot so as to make the bore accessible from the handrail's exterior surface. This modified handrail is also to provided with a wrist securing device that works in cooperation with the handrail's cavity for keeping the wrist of a user in close proximity to the handrail when the user is traversing the stairway.

12 Claims, 2 Drawing Sheets

HANDRAIL FOR PREVENTING STAIRWAY FALLS

CROSS-REFERENCE TO RELATED APPLICATION

This application is a continuation-in-part of the patent application U.S. Ser. No. 11/998,633—filed Nov. 30, 2007 now abandoned. The teachings of this prior patent application are incorporated by reference herein and to the extent that they do not conflict with the teachings of the present application.

BACKGROUND OF THE INVENTION

1. Field of the Invention

The present invention relates generally to static structures and the handrails found therein, and, in particular, to a handrail adjoining a stair that is configured to minimize the risk of one falling on the stairs.

2. Description of the Related Art

Handrails are well known parts of multi-story buildings that are primarily used for the purpose of trying to prevent a person from falling when ascending or descending a stairway.

However, despite the use of handrails, each year thousands of people die and tens of thousands are injured from falls on stairways in their homes and in other places. Several conventional devices have been developed in order to reduce the number of injuries resulting from ascending or descending a stairway.

For example, U.S. Pat. No. 3,992,832 discloses a stairway safety suspension support apparatus. This apparatus provides a plurality of loops along the stairway which a person can grasp in the event of a fall.

U.S. Pat. No. 4,253,287 discloses a step walker for use in conjunction with a stairway. In this apparatus, a walking bar is temporarily positioned within guide slots as the person walks up or down the stairway.

U.S. Pat. No. 4,899,989 discloses an alternative to the standard or conventional stairway handrail. This alternative includes a rail that is secured to a wall adjacent a stairway. However, the configuration of this rail is such that the rail itself is not meant to be grabbed and held in the standard manner by one traversing the stairway. Instead, the rail has a bore that extends along the longitudinal extent of the rail and, through a slit opening in the side of the bore, receives one end of a handle that is slidable on the side of the rail and along its longitudinal extent. The other end of the handle has a loop which is held and pushed by one who is traversing the stairway so as to cause the handle to slide along the rail. The stated advantage of this alternative is that its handle can be gripped at all times so that a user in traversing a stairway does not have to grip, release and regrip the rail—thus supposedly decreasing the likelihood of a accident by eliminating the periods when a rail is not being gripped or held.

U.S. Pat. No. 5,167,297 discloses a waist-wrapped, safety harness which one wears when ascending and descending a stairway. This safety harness has a tether which is looped around an adjoining tubular handrail that is supported only at its ends.

U.S. Pat. No. 6,270,058 discloses a handrail whose cross-sectional shape is especially configured so that it sits further away from an adjoining wall and thereby makes it easier for one to grasp and lean on such a handrail so as to prevent a stairway fall. U.S. Pat. No. 7,093,825 also has a handrail with a uniquely shaped cross-section that seeks to help prevent stairway falls and other dangers during a broader spectrum of movements.

With the number of elderly people in the U.S. on the rise, there is a continuing need for improvements in handrails that will make people's movements on stairways safer.

OBJECTS AND ADVANTAGES

There has been summarized above, rather broadly, the prior art that is related to the present invention in order that the context of the present invention may be better understood and appreciated. In this regard, it is instructive to briefly consider the objects and advantages of the present invention.

It is an object of the present invention to provide an improved handrail whose use will make it safer for the elderly and others (e.g., those with ambulatory infirmities, poor vision or balance problems) to ascend or descend stairs.

It is an object of the present invention to provide a low-cost way to modify an otherwise conventional pole-like handrail so that this modified handrail's use will make it safer for the elderly and others (e.g., those with ambulatory infirmities, poor vision or balance problems) to ascend or descend stairs.

It is an object of the present invention to provide a low-cost way to retrofit existing pole-like handrails so that such a retrofitted handrail's use will make it safer for the elderly and others (e.g., those with ambulatory infirmities, poor vision or balance problems) to ascend or descend stairs.

It is an object of the present invention to modify or retrofit an otherwise conventional pole-like handrail, of the type that is mounted on the sidewall of a stairway and has an upper portion which is configured to be easily grasped by one utilizing the stairway, so that this modified or retrofitted handrail: (a) allows one who fears that he or she might fall in the stairway to use an especially designed wrist device that attaches to the modified or retrofitted handrail so as to prevent such a person from losing his or her grasp of the handrail, and (b) is not modified in such a way that its upper graspable portion is less usable by the those stairway users who have little or no fear of traversing the stairway and thus decline to use the present invention's wrist device.

It is an object of the present invention to modify or retrofit an otherwise conventional pole-like handrail, of the type that is mounted on the sidewall of a stairway and has an upper portion which is configured to be easily grasped by one utilizing the stairway, so that this modified or retrofitted handrail can still be just as easily used in the conventional manner by those who do not elect to use the present invention's especially designed wrist device that attaches to this modified or retrofitted handrail so as to prevent a person from losing his or her grasp of the handrail.

It is an object of the present invention to contribute to the reduction in the number of falls suffered by the elderly and others (e.g., those with ambulatory infirmities, poor vision or balance problems) when ascending or descending stairs.

It is an object of the present invention to contribute to the possibility that the elderly can continue to reside in their multi-story dwellings without having the fear of falling and being injured while using the dwellings stairways.

These and other objects and advantages of the present invention will become readily apparent as the invention is better understood by reference to the accompanying summary, drawings and the detailed description that follows.

SUMMARY OF THE INVENTION

Recognizing the need for the development of improved handrails that will contribute to minimizing the risk of falls on the stairs on which such handrails are used, the present invention is generally directed to satisfying the needs set forth above and overcoming the safety limitations seen in the prior handrails.

In accordance with a preferred embodiment of the present invention, an improved handrail of the type includes: (a) a two-part cavity in the interior of the handrail and extending between its ends, with its first part being a slot that extends from the handrail's top surface and into its interior and its second part being a bore that is situated proximate the handrail's centerline and joined with the slot so as to make the bore accessible from the handrail's top surface, (b) a member which has a characteristic dimension that is less than that of the slot's width, (c) an adjustable wrist band, attached to a first end of the member, that has a shape which allows the is band to be wrapped around the wrist of a person who wishes to use the handrail, and (d) a stopper or spacer, having a characteristic dimension that is less than the characteristic dimension of the bore but greater than the slot's width, which is situated in the bore and attached to the member's second end and configured so that it is slideable along the entire length of the bore.

A person using the present invention: (i) inserts his or her hand into the wrist band and adjusts it so that it is secure on the wrist, (ii) holds onto the handrail and proceeds up or down the stairs in a normal manner; meanwhile, the wrist band slides in close proximity to the handrail's top surface while the stopper or spacer slides within the handrail's bore, (iii) upon completing one's traverse of the stairs, one unhooks the wrist band and proceeds. If for any reason the person should, during the ascent or descent of the stairs, let go of the handrail and try to pull his or her hand away from the handrail—one would not be able to do so since such an action would tend to pull the member up through the slot and cause the spacer to contact the top of the bore where it cannot pass through the handrail's slot and where friction between the spacer and the bore's top surface will prevent the wrist band from being moved further up or down the stair.

Thus, using the present invention, a person's hand or wrist is always held close to the handrail so that one may possibly regrip it should one feel oneself losing his or her balance and about to fall or, in a worst case scenario, be prevented from tumbling down the stairs.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
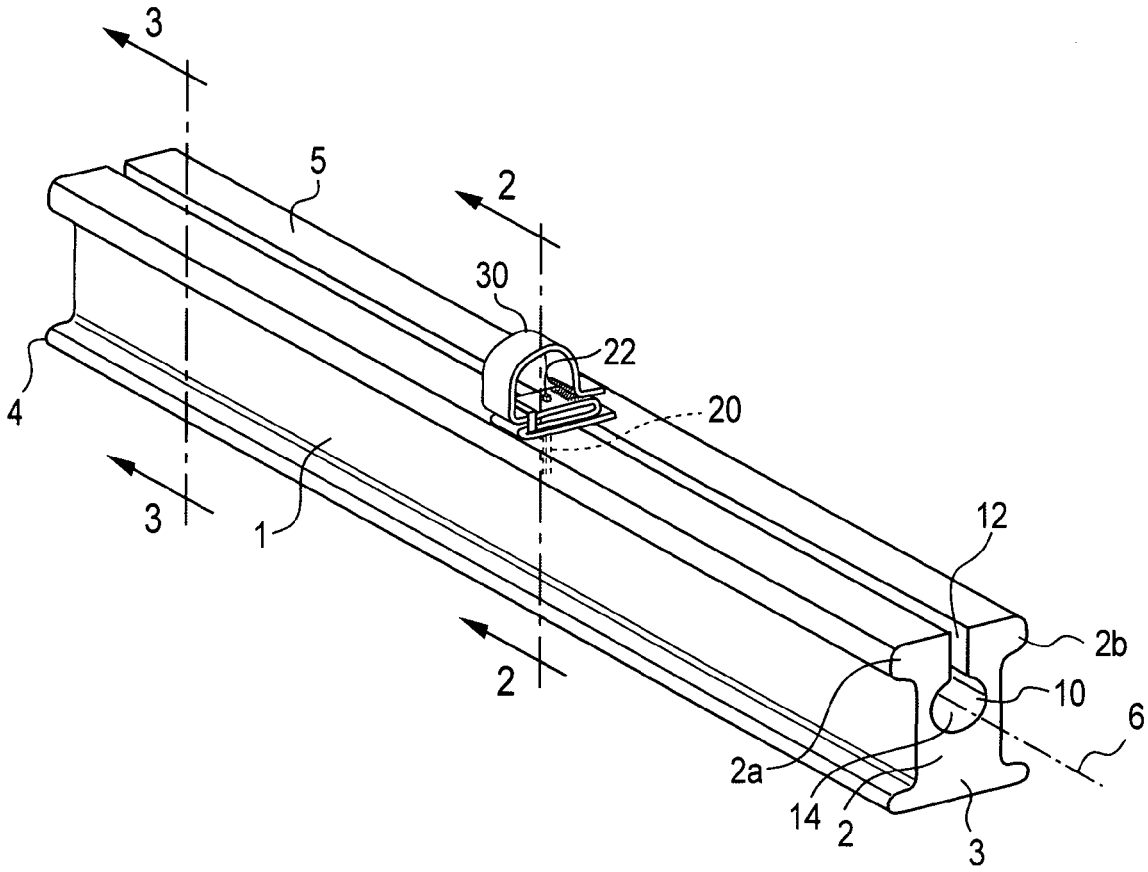
FIG. 1 is a perspective view of the present invention.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The present invention, in the form of a safer handrail, reduces the risk of one who uses such a handrail from falling when ascending or descending the stairway that the handrail serves.

FIG. 1 shows a first preferred embodiment of a modified version of an otherwise conventional, pole-like handrail. It is seen to be a handrail 1 which has a relatively conventional looking exterior surface that includes a symmetrical-about-its-lateral-centerline upper portion with two, top surface outer edges (note: top surface for the purpose of this application is defined as that surface which would be on the upper or higher end of a straight line which is aligned with the direction of the earth's gravitational pull; i.e., between two surfaces, the top surface is that which is on average the furtherest distance away from the earth's center). This symmetric, upper portion is configured so that both its top surface outer edges are easily simultaneously gripable by one hand of one going up and down a stairway. The handrail's interior 2 has a relatively rectangular, cross-sectional shape that is uniform between its two ends 3, 4 and along its longitudinal extent. Its upper portion has protrusions 2*a*, 2*b*; one of which extends laterally and symmetrically from each side of its top surface 5 so as to make it easier to grip the handrail's top surface. This handrail also has a longitudinal centerline 6 that extends between its ends. A number of spaced-apart, mounting brackets, that typically attach to the handrail's bottom surface, may be used to mount the handrail to a stairway's adjoining vertical wall.

Figure 2:
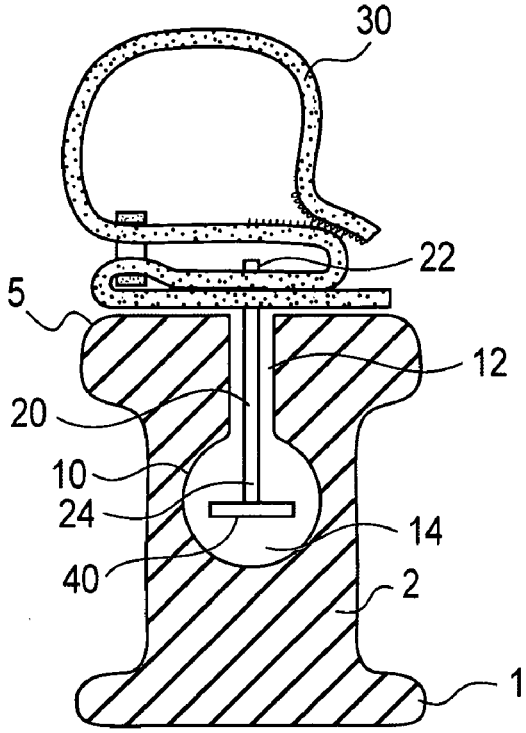
FIG. 2 is the cross-sectional view 2-2 shown in FIG. 1.

The modifications or improvements to this otherwise relatively conventional looking handrail must be made such that they make it safer to use for one who is fearful of possibly falling in a stairway, but do not in any way lessen or degrade the usability of the handrail for one who desires to use the handrail in the typical manner and thus is not unduly concerned about failing in a stairway. These improvements include: (a) a cavity 10 that extends between the handrail's ends and from the handrail's top surface 5 and into its interior 2; this cavity consists of two parts where the first part is a slot 12 of a prescribed width, s (e.g., approximately 0.25 inches), that extends from the handrails' top surface 5 and is joined on its interior portion to a bore 14 of characteristic dimension, b (e.g., 1 inch), that is situated proximate the centerline of the handrail and accessible through the slot 12 from the handrail's top surface 5, (b) a member 20 with two ends 22, 24 and a characteristic diameter or dimension, c, that is less than that of the slot's width, s, (c) a wrist securing means that one can attach to and, upon ascending or descending a stairway, then detach from one's wrist (see, for example, the hook and loop fasteners seen FIG. 2), consisting of an adjustable size, wrist band 30 that has a shape which allows it to be wrapped around or enclose the wrist of the hand that a person who wishes to use the handrail is also simultaneously using to grasp the top surface's outer edges, and with this band 30 being attached to the member's first end 22, and (d) a stopper or spacer 40 that has a characteristic dimension, p (e.g., 0.75 inches), that is less than that of the bore but greater than that of the slot, and is affixed to the member's second end 24 and situated within the handrail's bore 14; with this spacer having an exterior surface and shape that is configured so as to allow it to be slideable along the entire length of the bore 14. See also FIG. 2's cross-sectional view 2-2.

The slot's union with the handrail's exterior surface is smoothly rounded to prevent the member 20 that goes through the slot 12 from being damaged and to ensure that the tactile feel that a user experiences when grasping the handrail's upper portion is not adversely affected in order to prevent it being less likely that one would grasp said handrail in traversing said stairway because of said slot width. In one embodiment of the present invention, its spacer is formed by tying a suitably sized knot in the member's second end.

A person using the present invention to ascend or descent a stairway inserts his or her hand into the wrist band 30 and adjusts it so that it is secure on the wrist. The person then holds onto the handrail 1 and proceeds up or down the stairs in a normal manner. During this process, the wrist band slides in close proximity to the handrail's top surface 5 while the spacer 40 slides within the handrail's bore 14. Upon completing one's traverse of the stairs, one unhooks the wrist band and proceeds. A line can be added to the wrist band assembly so that it can be brought to the other end of the handrail 1 in the event that its last user has left it at the opposite end of the handrail from which the next user wishes to ascend or descend the stairs.

If for any reason a person should, during a stairway ascent or descent, let go of the handrail 1 and try to pull his or her hand away from the handrail—he or she would not be able to do so since such an action would tend to pull the member 20 up through the slot 12 and such action would be stopped when the spacer 40 contacts the top of the bore and cannot pass through the handrail's slot and where friction between the spacer and the bore's top surface will prevent the wrist band from being moved further up or down the stair. The material used to construct the spacer 40 can be chosen so that its surface has the appropriate coefficient of friction with the bore's surface so as to provide the necessary frictional or binding force to prevent the wrist band's further movement.

Figure 3:
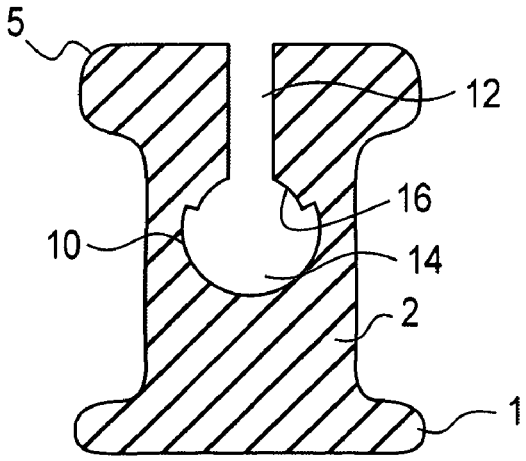
FIG. 3 is the cross-sectional view 3-3 shown in FIG. 1.

An alternative to this friction stop is shown in FIG. 3. It consists of dams 16 located within the bore which extend from the top portion of the bore or at the intersection of the slot 12 with the bore 14 and at spaced apart lengths along the longitudinal extent of the bore 14. These dams provide a positive stop for the spacer when it is pulled upward, by a user pulling her or her hand away from the handrail, and encounters a dam that prevent it from sliding further along the bore. Typical dimension for these dams 16 are ⅛ of an inch in height, 2 inches in lateral extent and with centerlines that are spaced apart every 12 inches along the bore's lateral extent.

Using the present invention, a person's hand or wrist is always held close to the handrail. If one is sufficiently alert when he/she loses his/her balance while using the present invention and traversing a flight of stairs, the person can possibly grab or regrip the, now necessarily, nearby handrail 1 and hopefully prevent a fall on the stairs. However, if the person cannot regrab the handrail lafter losing his/her balance, he/she will as a result of his/her inevitable pull on the wrist band 30 and its consequent binding or locking of itself in its present position, be prevented from tumbling down the stairs.

A removable cover piece may be attached to each end of the handrail to provide easy access to the handrail's cavity 10 and thereby a way to service, if necessary, the present invention's member and spacer. Additionally, this easy access to the handrail's cavity makes it feasible to leave one or two spare wrist bands at either end of the handrail so that one of them can be used when needed by just inserting its spacer into the handrail's cavity.

It should be recognized that there are many obvious materials that can be used to construct the present invention and all of these should be considered to come within the scope of this invention's disclosure. For example, the handrail 1 may be made from wood and have a cross-sectional shape as shown in FIG. 1. Alternative, the handrail can be a metal or plastic pipe or tube having a circular cross-section that allows the use of a slot and bore application.

Similarly, the spacer 40 can be a simple, appropriately sized knot that is tied in the member near its inner or second end 24 or it may be a more involved piece that is configured to slide optimally well in the handrail's bore and bind quickly when a outward pull on the member brings it into frictional contact with the bore's top surface. In a further simplification of the present invention, the other end 22 of the member can be extended and possibly formed into an adjustable—sized loop which can possibly serve as the wrist band portion of the present invention. Thus, hereinafter when we speak of a spacer and wrist band, this terminology should, in its broadest sense, be understood to convey that these elements may be fashioned from the present invention's member.

A hook and loop tape of approximately two inches in width has been found to be a very convenient material from which to make the adjustable wrist band of the present invention.

While the present invention has been discussed above in terms generally related to its use in private spaces and homes, it should also be recognized that a version of it can easily be adapted for use in public spaces where there are hundreds or thousands of users of the same stairway or handrail. In such applications (public handrails), it can be used by standardizing on the dimension's of the handrail's cavity (e.g., a 0.25 inch slot with a 1 inch bore) so that size of the present invention's member and spacer can also then be standardized for use in any number of standardized handrails. People could then carry their own standard-sized, member-spacer combinations which could be used in any such standardized public handrails that one might encounter in her/her travels.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention that is hereinafter set forth in the claims to this invention.

I claim:

1. An improved conventional handrail of the type that has an exterior surface that includes a top surface with two outer edges and which has a lateral centerline about which said top surface is symmetrical, an interior surface, two ends, a longitudinal centerline extending between said ends, and an upper portion that includes said symmetrical top surface and has a configuration that allows both said outer edges to be simultaneously grasped by one hand of one traversing said stairway, wherein the improvements comprising:

a cavity in the interior of said handrail that extents between said handrail ends, wherein said cavity having a first and a second part, said first part being a slot of a prescribed width that extends from said handrail top surface and into the interior of said handrail, said second part being a bore that is situated proximate the centerline of said handrail and joins with said slot so as to make said bore accessible through said slot from said handrail top surface, wherein said bore having a characteristic dimension that is greater than the width of said slot, and a wrist securing means having a configuration that allows said means to be attached and detached from the wrist of the hand that one also uses to simultaneously grasp said handrail top surface outer edges while traversing a stairway and to work in cooperation with said handrail cavity for keeping said wrist of one who uses said wrist securing means in close proximity to said handrail in the event of said user releasing the user's grasp of said handrail when said user is traversing said stairway; and a plurality of dams located within said bore, each of said dams extending from a point proximate the intersection of said slot with said bore, said points being spaced apart at a prescribed distance along the longitudinal extent of said bore.

2. The improved handrail as recited in claim 1, wherein:

said wrist securing means having:

a member having a first and a second end and a characteristic cross-sectional dimension that is less than that of said slot width, a wrist band that has a shape which allows said wrist band to enclose the wrist of a person who wishes to use said handrail, said band attached to the first end of said member, and a spacer having a characteristic dimension that is less than the characteristic dimension of said bore but greater than the width of said slot, said spacer being fixed to the second end of said member and having an exterior shape and surface that allows said spacer to be placed in said bore so that said spacer is slideable within said bore.

3. The improved handrail as recited in claim 1, wherein:

said prescribed width of said slot is chosen to be sufficiently small so that said intersection of said slot with said top surface does not adversely affect the tactile feel that one experiences in grasping said handrail in order to prevent it being less likely that one would grasp said handrail in traversing said stairway because of said slot width.

4. The improved handrail as recited in claim 2, wherein:

said prescribed width of said slot is chosen to be sufficiently small so that said intersection of said slot with said top surface does not adversely affect the tactile feel that one experiences in grasping said handrail in order to prevent it being less likely that one would grasp said handrail in traversing said stairway because of said slot width.

5. The improved handrail as recited in claim 1, wherein:

said handrail improvements are configured such that said handrail is equally as useful for both those who do and do not elect to use said wrist securing means.

6. The improved handrail as recited in claim 2, wherein:

said handrail improvements are configured such that said handrail is equally as useful for both those who do and do not elect to use said wrist securing means.

7. A method for modifying a conventional handrail of the type that has an exterior surface that includes a top surface with two outer edges and which has a lateral centerline about which said top surface is symmetrical, an interior surface, two ends, a longitudinal centerline extending between said ends, and an upper portion that includes said symmetrical top surface and has a configuration that allows both said outer edges to be simultaneously grasped by one hand of one traversing said stairway, said method comprising the steps of:

providing a cavity in the interior of said handrail that extents between said handrail ends, wherein said cavity having a first and a second part, said first part being a slot of a prescribed width that extends from said handrail top surface and into the interior of said handrail, said second part being a bore that is situated proximate the centerline of said handrail and joins with said slot so as to make said bore accessible through said slot from said handrail top surface, wherein said bore having a characteristic dimension that is greater than the width of said slot, and providing a wrist securing means having a configuration that allows said means to be attached and detached from the wrist of the hand that one also uses to simultaneously grasp said handrail top surface outer edges while traversing a stairway and to work in cooperation with said handrail cavity for keeping said wrist of one who uses said wrist securing means in close proximity to said handrail in the event of said user releasing the user's grasp of said handrail when said user is traversing said stairway; and a plurality of dams located within said bore, each of said dams extending from a point proximate the intersection of said slot with said bore, said points being spaced apart at a prescribed distance along the longitudinal extent of said bore.

8. The method as recited in claim 7 wherein:

said wrist securing means having:

a member having a first and a second end and a characteristic cross-sectional dimension that is less than that of said slot width, a wrist band that has a shape which allows said wrist band to enclose the wrist of a person who wishes to use said handrail, said band attached to the first end of said member, and a spacer having a characteristic dimension that is less than the characteristic dimension of said bore but greater than the width of said slot, said spacer being fixed to the second end of said member and having an exterior shape and surface that allows said spacer to be placed in said bore so that said spacer is slideable within said bore.

9. The method as recited in claim 7, wherein:

said prescribed width of said slot is chosen to be sufficiently small so that said intersection of said slot with said top surface does not adversely affect the tactile feel that one experiences in grasping said handrail in order to prevent it being less likely that one would grasp said handrail in traversing said stairway because of said slot width.

10. The method as recited in claim 8, wherein:

said prescribed width of said slot is chosen to be sufficiently small so that said intersection of said slot with said top surface does not adversely affect the tactile feel that one experiences in grasping said handrail in order to prevent it being less likely that one would grasp said handrail in traversing said stairway because of said slot width.

11. The method as recited in claim 7, wherein:

said handrail improvements are configured such that said handrail is equally as useful for both those who do and do not elect to use said wrist securing means.

12. The method as recited in claim 8, wherein:

said handrail improvements are configured such that said handrail is equally as useful for both those who do and do not elect to use said wrist securing means.

* * * * *